US006493899B1

(12) United States Patent
Hintz et al.

(10) Patent No.: US 6,493,899 B1
(45) Date of Patent: Dec. 17, 2002

(54) DEVICE TO BLEND PLANT ON WALLS

(76) Inventors: Nathaniel J. Hintz, 4515 S. Durango, #2166, Las Vegas, NV (US) 89147; Shawn C. Spencer, 2867 N. Jones, Las Vegas, NV (US) 89108; Perry M. Spencer, 2867 N. Jones, Las Vegas, NV (US) 89108; Scott L. Flanigan, 4596 Cedar Spring Dr., Las Vegas, NV (US) 89103

( * ) Notice: Subject to any disclaimer, the term of this patent is extended or adjusted under 35 U.S.C. 154(b) by 0 days.

(21) Appl. No.: 09/805,149

(22) Filed: Mar. 14, 2001

(51) Int. Cl.[7] ..... B05C 17/00
(52) U.S. Cl. ..... 15/231; 15/147.1
(58) Field of Search ..... 15/147.1, 228, 15/231

(56) References Cited

U.S. PATENT DOCUMENTS 867,479 A * 10/1907 Childress
869,842 A * 10/1907 Hill
1,406,721 A * 2/1922 Boyle
1,449,856 A 3/1923 Hampson
1,709,331 A * 4/1929 Waters
1,761,109 A 6/1930 Dietz
2,233,565 A * 3/1941 Whelan, Sr.
2,300,911 A * 11/1942 Cravis
2,419,748 A * 4/1947 Weber
2,551,105 A 5/1951 Eiden et al.
2,952,028 A 9/1960 Robbins
3,473,184 A * 10/1969 Buck, Jr.
3,817,178 A 6/1974 Hagen
3,996,639 A * 12/1976 Griffin
4,030,414 A 6/1977 McGuire
4,225,998 A * 10/1980 Thielen
4,919,975 A 4/1990 Jones
5,419,015 A * 5/1995 Garcia
5,866,206 A 2/1999 Jennings-Tolchiner
6,058,552 A * 5/2000 Hanan

* cited by examiner

*Primary Examiner*—Randall E. Chin
(74) *Attorney, Agent, or Firm*—Richard C. Litman

(57) ABSTRACT

A device to blend wet paint on walls, floors and the like surfaces to create a decorative faux effect comprising a rectangular aluminum plate having side clamps for holding an applicator pad material over a sponge removably attached to the bottom surface of the plate by hook and loop fastening material. The device has a handle which can be either a cantilever steel arm with a plastic grip or a C-shaped handle having both ends attached to the plate. The pad material can be either a fluffy wool, leather, a velvet cloth, a plastic sheet, a terry cloth, a denim cloth, or carpet fabric.

13 Claims, 5 Drawing Sheets

DEVICE TO BLEND PLANT ON WALLS

BACKGROUND OF THE INVENTION

1. Field of the Invention

The present invention relates generally to wall decoration tools. More specifically, the invention is a lightweight paint blending tool for applying a faux paint finish to a wall or other surface. The device has two different sizes, a rectangular aluminum base with side clamps for holding a fluffy pad on a sponge base, and a full or half handle.

2. Description of the Related Art

The related art of interest describes various painting hand tools, but none discloses the present invention. There is a need for smoothing and creating decorative patterns of fresh paint on planar or even outwardly curved surfaces. The related art will be discussed in the order of perceived relevance to the present invention.

U.S. Pat. No. 5,866,206 issued on Feb. 2, 1999, for Barbara Jennings-Tolchiner describes decorative faux painting apparatus and methods of use comprising paint brushes, tapes, and a rectangular plastic handled tool having a plastic planar body with wool having its skin wrapped around the body, but the method of securing is not disclosed. No other equivalent pad materials have been disclosed. It has been found that this plastic device is fragile and readily broken in use. The device is distinguishable for its fragile structure and lack of a sponge backing and clamps.

U.S. Pat. No. 3,817,178 issued on Jun. 18, 1974, for Dean C. Hagen describes tools for ornamenting walls and ceilings comprising an aluminum or magnesium plate stock ⅛ inch thick and 8.5 inches square attached to a backing plate having a screwed on full handle and a hook at the end for attaching a chain for ceiling coating of a cement mixture. Various foam and dense pads of polyurethane and the like of different densities and pattern shapes are used. The tools are distinguishable for the patterned pads and the chain hook.

U.S. Pat. No. 4,919,975 issued on Apr. 24, 1990, for Evan W. Jones describes an applicator device for producing a painted marbleized paint finish comprising a fluffy material boot cover with a tie string to attach to the circular domed head portion having a cylindrical handle. The tool is distinguishable for its distinctive boot cover and holder.

U.S. Pat. No. 4,030,414 issued on Jun. 21, 1977, for James T. McGuire describes a wall decorating paint applying device comprising of a one-piece rectangular cellulose sponge body having a relieved, design defining, paint imprinting face with a finger grippable, sponge handle portion. The device is distinguishable for its sponge body and handle.

U.S. Pat. No. 1,449,856 issued on Mar. 27, 1923, for Charles G. Hampson describes a stippling tool for paper and fabrics comprising a rectangular rubber sponge glued to a back support having a peripheral retaining bead. A full handle is attached to the back support. The tool is distinguishable for its simplified sponge and beaded back support with a handle.

U.S. Pat. No. 2,952,028 issued on Sep. 13, 1960, for Roy F. Robbins describes a rectangular cement and plastering trowel comprising a full handle on a rectangular metal base or guard having a finishing float of sponge rubber attached by adhesive. The trowel is distinguishable for being limited to the handle, metal base and sponge rubber.

U.S. Pat. No. 1,761,109 issued on Jun. 3, 1930, for Leo S. Dietz describes a plasterer's float device comprising a rectangular sponge rubber block having a smooth face rubber cemented to a stiff back piece having a full handle fastened by screws. The back piece can be hard rubber, fibre, wood or metal. The device is distinguishable for being limited to a handle, back piece and rubber sponge.

U.S. Pat. No. 2,551,105 issued on May 1, 1951, for Leslie J. Eiden et al. describes a plastering tool comprising a full handle connected to a foraminous sheet between two layers of sponge rubber by posts and pins in the handle's standards. The tool is distinguishable for requiring a foraminous metal core in the sponge rubber for attachment of the handle.

None of the above inventions and patents, taken either singularly or in combination, is seen to describe the instant invention as claimed. Thus, a device to blend paint on walls solving the aforementioned problems is desired.

SUMMARY OF THE INVENTION

The present invention is a lightweight paint blending tool for smoothing decorative faux, e.g., marbled, wet paint on walls and the like. The device has a rectangular aluminum base with side clamps for holding an applicator pad over a sponge, and a handle attached to the base. A first embodiment is drawn to a large size tool having a partial handle with an open end. A second embodiment is drawn to a smaller size tool having a full handle. The tool has hook and loop patches attached to the aluminum base which releasably mate with a rough, fibrous backing material backing on the sponge for releasably attaching the sponge to the base. The side clamps on the upper surface of the base clamp a sheet of applicator material selected from the group consisting of wool, terry cloth, carpet fabric, leather, velvet, plastic, and denim cloth. Freshly painted surfaces are slapped with the device to blend the colors together for a softer faux and more subtle effect. The sponge decreases the painful effect on one's wrist after hours of slapping wet paint surfaces.

Accordingly, it is a principal object of the invention to provide a tool for blending decorative faux paint on freshly painted walls.

It is another object of the invention to provide a faux paint blending tool having a sponge pad under a lightweight base covered by a wet paint applicator element to enable less painful effort by the painter.

It is a further object of the invention to provide a tool having side clamps for attaching the applicator element to the faux paint blending tool.

Still another object of the invention is to provide a tool utilizing a wet paint faux creating applicator element selected from the group consisting of wool, terry cloth, carpet fabric, leather, velvet, plastic, and denim cloth.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a paint blending device for smoothing freshly painted latex surfaces to create a decorative faux effect, e.g., marbled. The method of use requires an extender cream, "Faux Creme", added to the latex paint, and pre-wetting of the pad of the device. The paint blending device can be offered in two sizes depending on the extent of the design area or the surface area to be treated.

Figure 1:
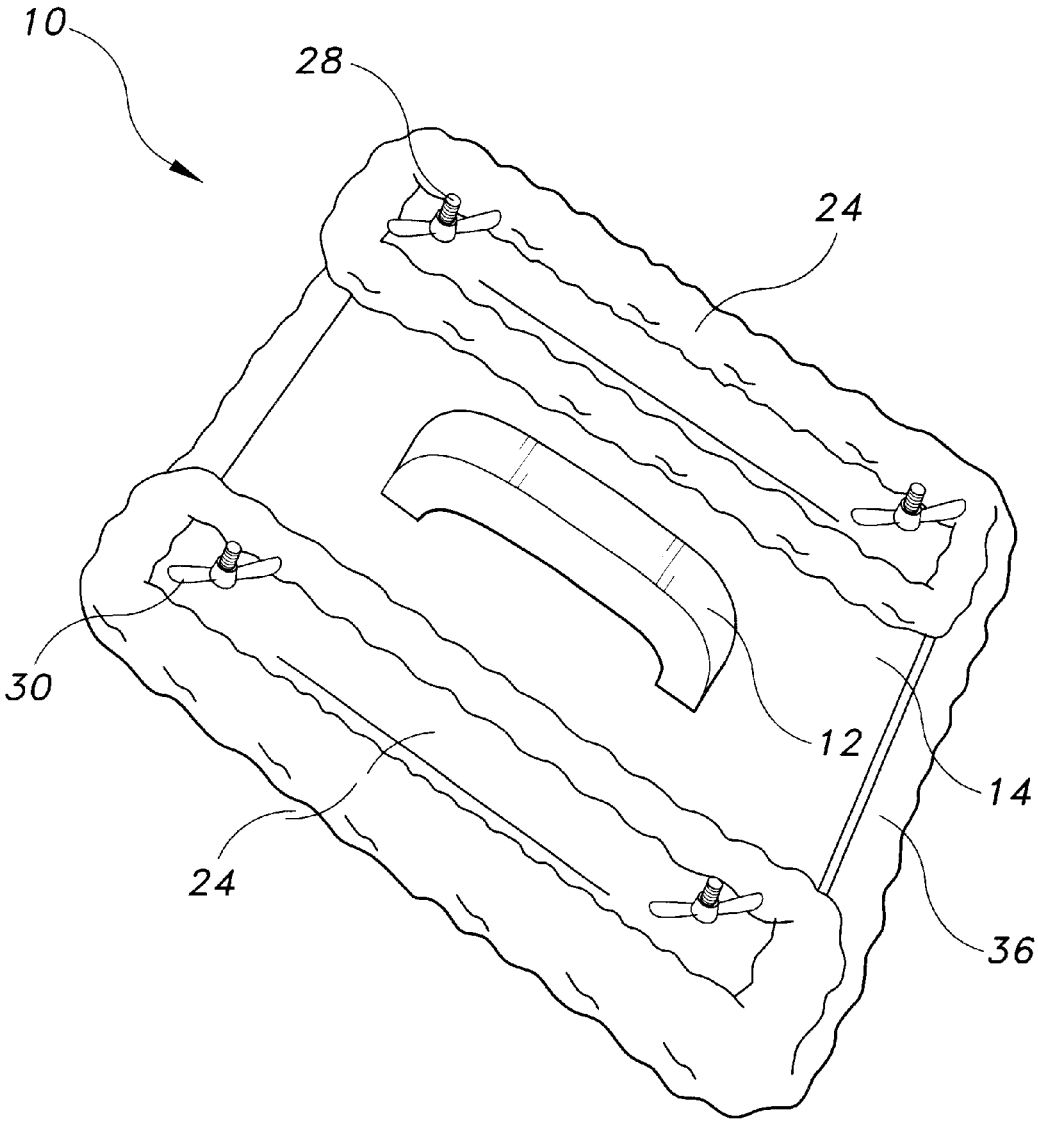
FIG. 1 is a perspective view of a first embodiment of a smaller sized blender device having a full handle to blend faux paint on walls according to the present invention.
Figure 5:
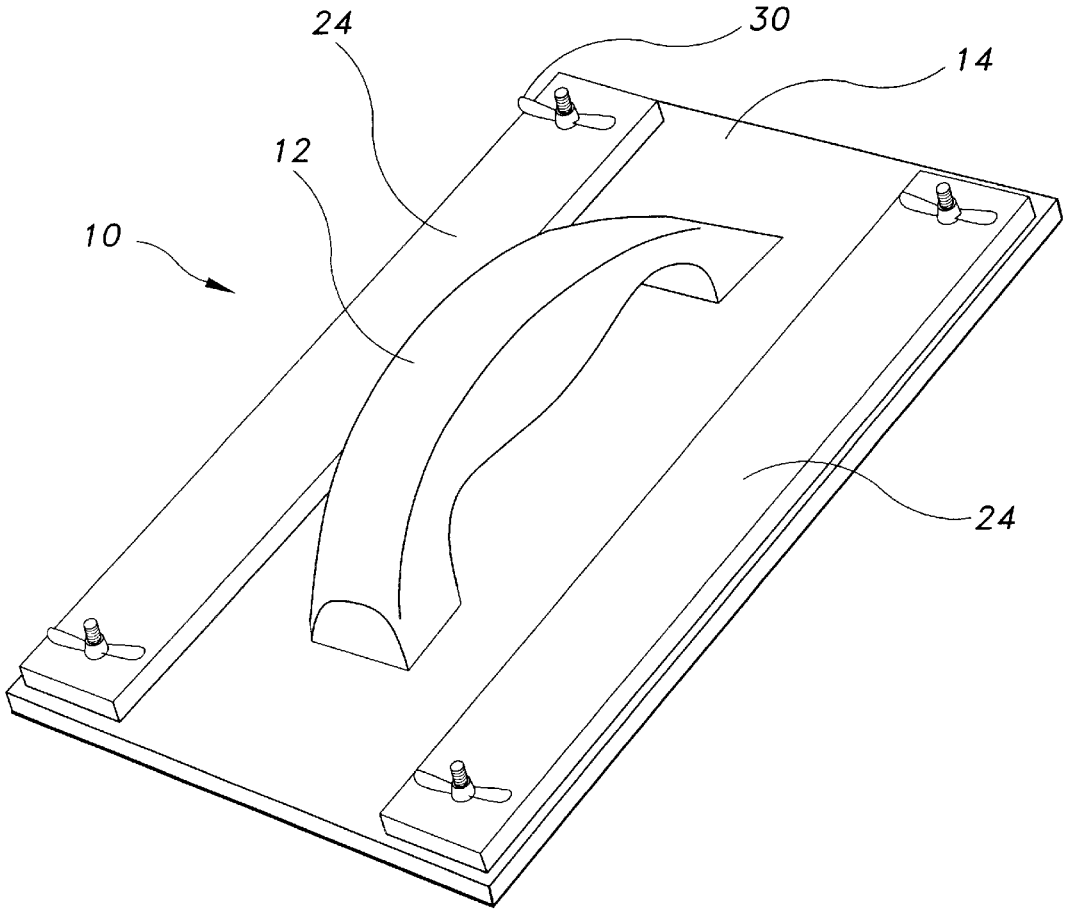
FIG. 5 is a top perspective view of the first embodiment blender device of FIG. 1, the sponge and applicator being removed.

A first embodiment of a small blending device 10 is illustrated in FIG. 1. The device has a full handle 12, i.e., a C-shaped loop with both ends attached to the top surface of the base 14. The handle 12 may be made of plastic or wood. The base 14 comprises a flat, rectangular aluminum plate 14 having a top surface and a bottom surface. The full handle 12 is attached to the top surface of the plate 14. A pair of elongated aluminum clamps 24 are removably secured to the plate 14 along opposing sides of the base by carriage bolts 28. The bottom surface of the base 14 has recesses defined therein so that the heads of the carriage bolts 28 are countersunk into the bottom surface. The clamps 24 are placed over the carriage bolts 28 and secured with wing nuts 30. The clamps 24 may be flat, as shown in FIG. 5, or bowed, as shown in FIG. 3.

A sponge pad 32 having a rough, fibrous backing 33 (shown in FIGS. 2 and 3), such as a sponge with a scrubbing or scouring pad attached, is removably attached to the device by providing hook and loop fastener patches 34 (FIG. 3) which are permanently attached to the bottom surface of the plate 14, as by adhesive. The hooks on the hook and loop material 34 engage the loops in the fibrous backing 33 to retain the sponge 32 on the plate 14. The sponge 32 is of sufficient size to cover substantially the entire bottom surface of the plate 14. The addition of the sponge pad 32 is critical to the invention, because a worker must punch the device 10 against the fresh paint surface repeatedly for a long duration, resulting in tense and sore arm muscles if the sponge pad 32 is omitted. A sheet or pad of applicator material 36 is wrapped around the plate 14, as illustrated in FIG. 1, and held in place over the sponge pad 32 by the pair of clamps 24. The applicator material can be either fluffy synthetic wool having a flexible base portion, terry cloth, carpet fabric, leather, velvet, denim cloth, or crumpled plastic. The plastic sheet can be a conventional plastic bag. The applicator pad 36 is sufficient in size to cover the entire bottom surface of the plate 14 and extend over the side edges of the plate 14 on at least two sides.

Figure 2:
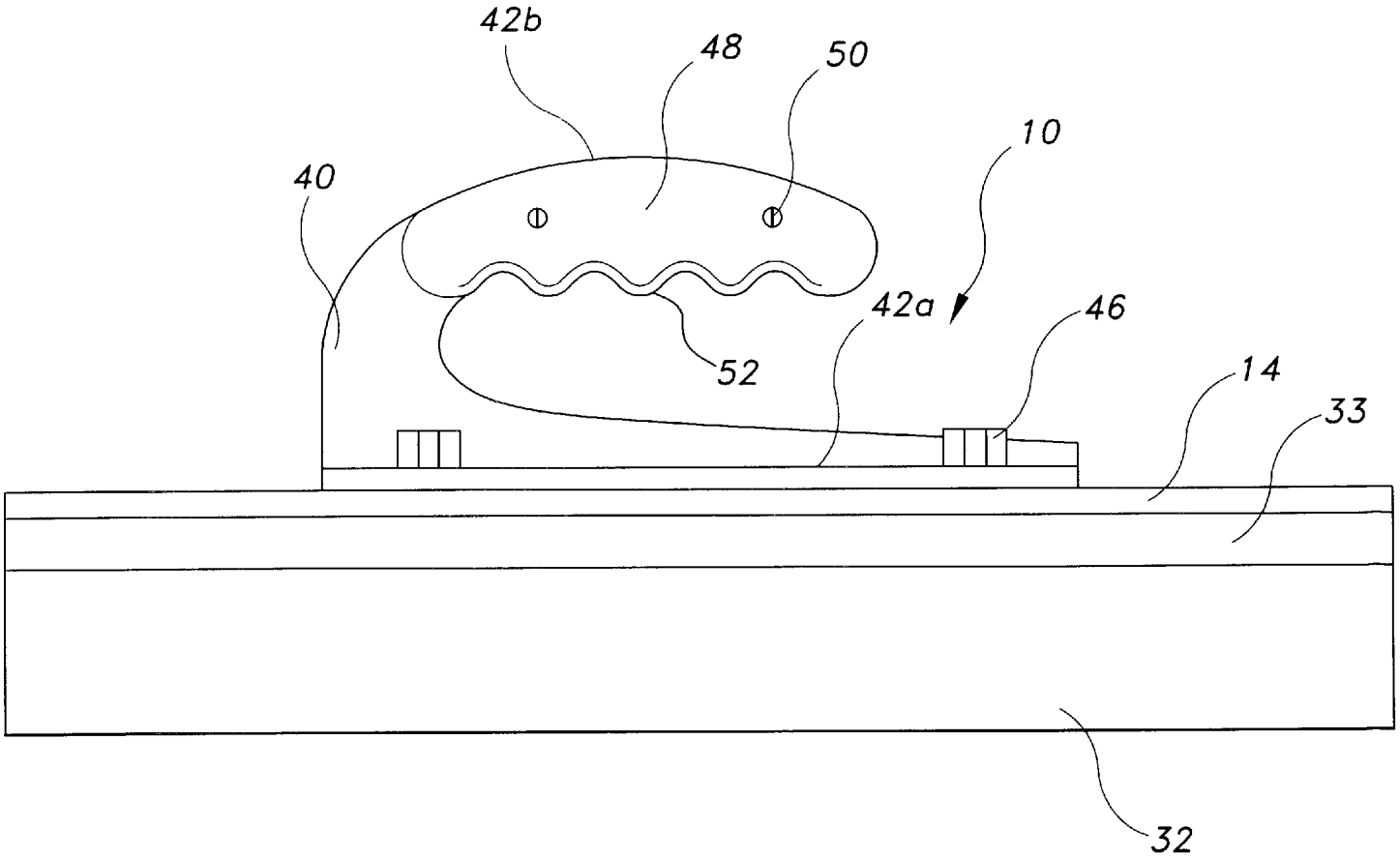
FIG. 2 is a side elevational view of a second embodiment of a larger sized blender device having a partial knuckled handle.
Figure 3:
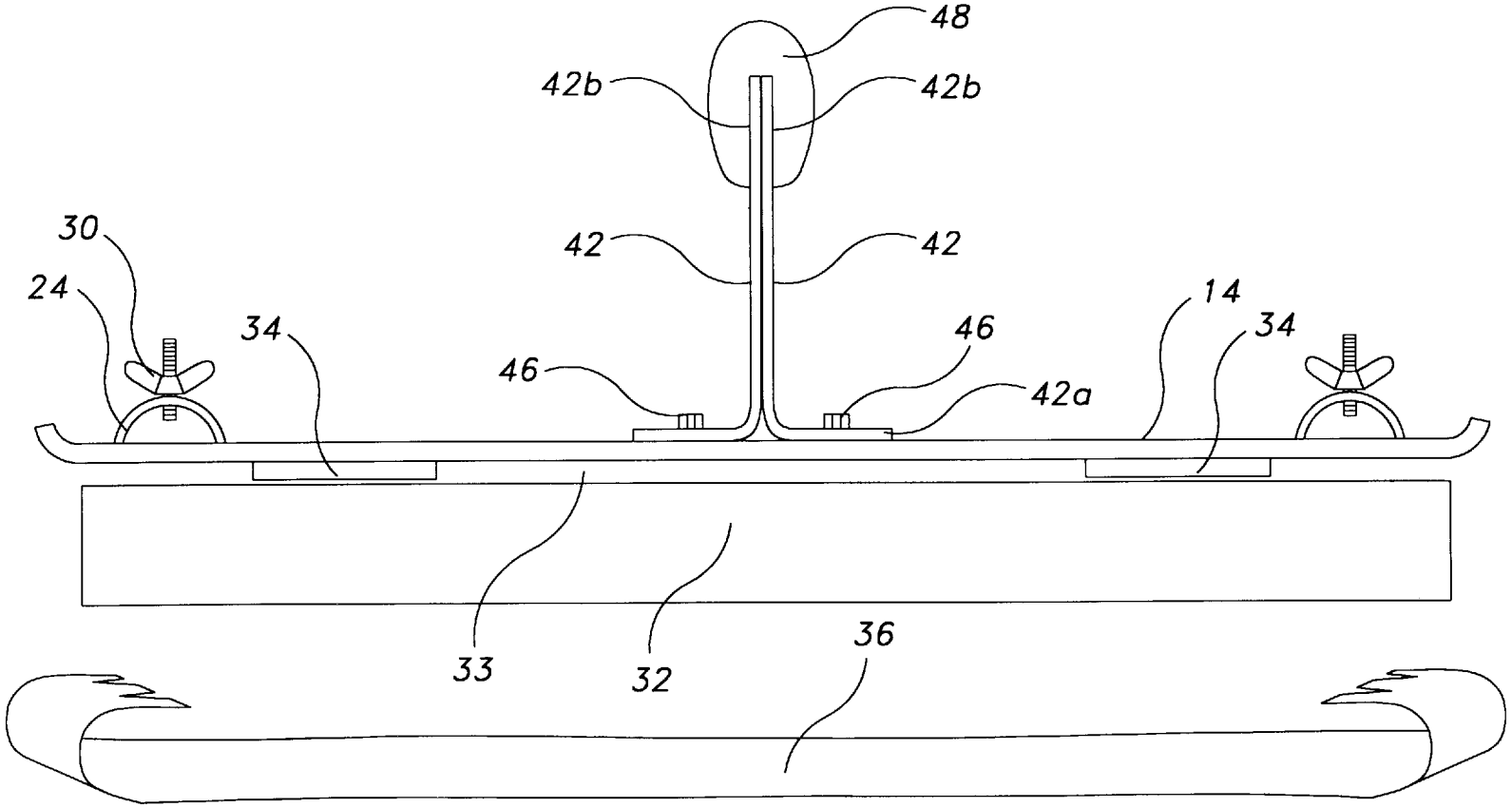
FIG. 3 is a front elevational view of the second embodiment FIG. 2 device.
Figure 4:
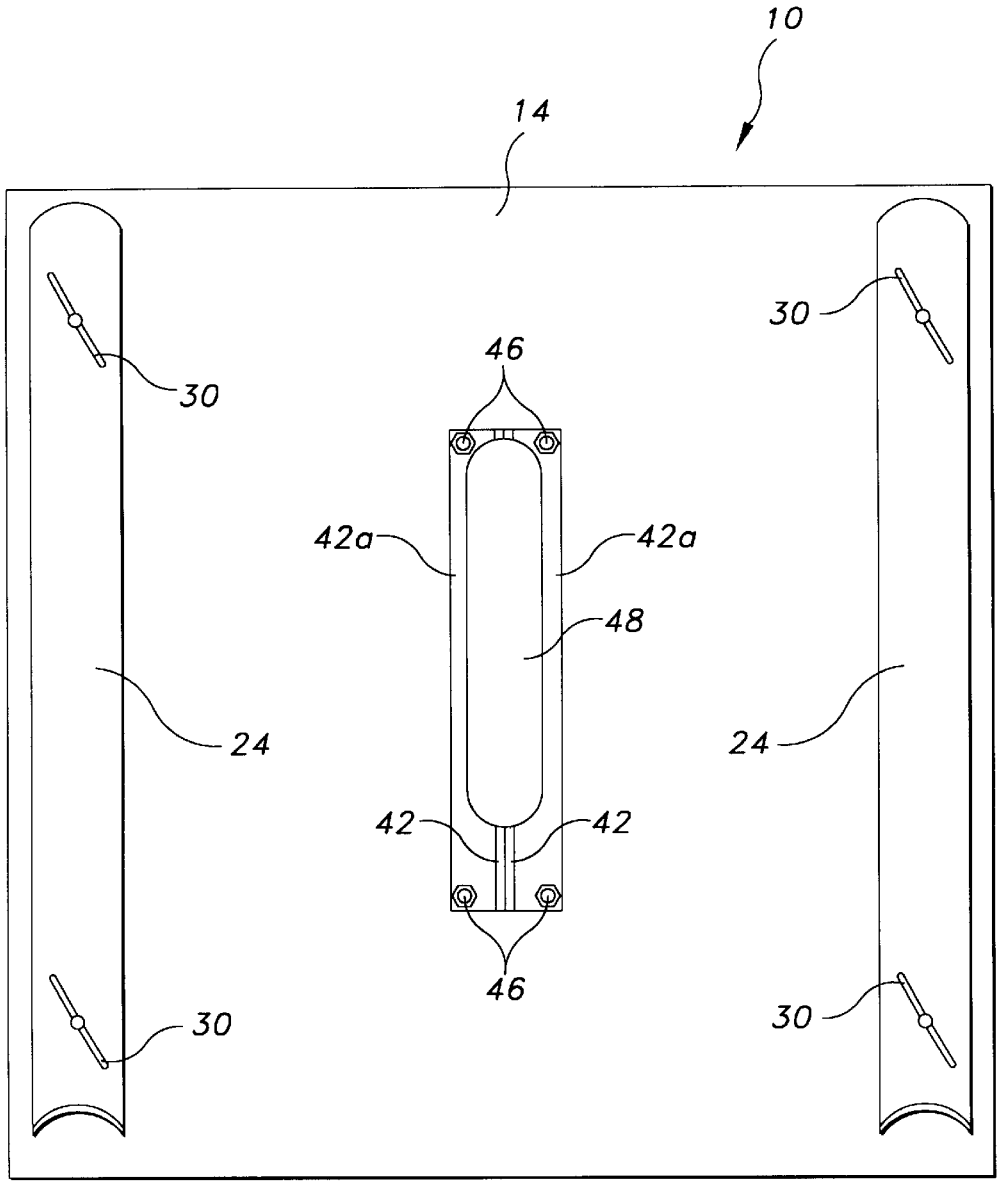
FIG. 4 is a top plan view of the second embodiment FIG. 2 device.

The second embodiment of the blending device 10, illustrated in FIGS. 2, 3 and 4, differs from the first embodiment of the device 10 in that the base plate 14 has larger dimensions, and in that the device 10 has a heavy duty handle. The handle 40 has a two-piece, galvanized steel frame including symmetrical plates 42 which have elongated base flanges 42*a* attached to the base plate 14 by screws or lock nuts 46. Plates 42 curl upward from base plate 14 to form cantilever grip arms 42*b* which extend substantially parallel to and above the base flanges 42*a*. A plastic or wooden grip 48 with a slot defined therein is placed over the abutting cantilever arms 42*b*, and screws 50 join the cantilever arms 42*b* flush against one another. The grip 48 has depressions 52 defined therein for curling the fingers around the grip 48 and preventing the user's hand from sliding on the grip 48. It is to be understood that the present invention is not limited to the embodiments described above, but encompasses any and all embodiments within the scope of the following claims.

We claim:

1. A device for blending fresh paint on walls to create faux paint decorative finishes, comprising:

a rectangular plate having a top surface and a bottom surface;

an elongated handle attached to the top surface of said plate, wherein said handle is a cantilever arm made from steel and having a plastic grip inserted over said cantilever arm;

a pair of elongated clamps removably attached to the top surface of said plate on opposite sides of said handle;

a sponge pad attached to the bottom surface of said plate; and an applicator pad wrapped around said sponge, the applicator pad covering the entire bottom surface of the plate and extending over at least two sides of said plate, being secured by said clamps;

whereby a painter can blend a freshly painted surface with the device to produce a faux effect.

2. The device according to claim 1, wherein the applicator pad material is selected from the group consisting of fluffy synthetic wool, leather, velvet cloth, plastic sheet, terry cloth, denim cloth, and carpet fabric.

3. The device according to claim 2, wherein the applicator pad is a fluffy synthetic wool.

4. The device according to claim 2, wherein the applicator pad is leather.

5. The device according to claim 2, wherein the applicator pad is a velvet cloth.

6. The device according to claim 2, wherein the applicator pad is a plastic sheet.

7. The device according to claim 2, wherein the applicator pad is a terry cloth.

8. The device according to claim 2, wherein the applicator pad is a denim cloth.

9. The device according to claim 2, wherein the applicator pad is a carpet fabric.

10. The device according to claim 1, further comprising at least one strip of hook and loop fastening material attached to the bottom surface of said plate.

11. The device according to claim 10, wherein said sponge pad further comprises a fibrous backing, the backing engaging said hook and loop fastening material in order to removably attach said sponge pad to the bottom surface of said plate.

12. The device according to claim 1, further comprising a plurality of threaded fasteners extending above the top surface of said plate and a plurality of wing nuts, said clamps being disposed on said threaded fasteners and temporarily secured by said wing nuts.

13. The device according to claim 1, wherein said plate is aluminum.

* * * * *